US009545803B2

(12) United States Patent
Horaguchi

(10) Patent No.: US 9,545,803 B2
(45) **Date of Patent: *Jan. 17, 2017**

(54) PRINTER WITH MECHANISM FOR CONTROLLING RECORDING MEDIUM TENSION

(71) Applicant: Seiko Epson Corporation, Tokyo (JP)

(72) Inventor: Norio Horaguchi, Kamiina-gun (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/074,739

(22) Filed: Mar. 18, 2016

(65) Prior Publication Data

US 2016/0200122 A1 Jul. 14, 2016

Related U.S. Application Data

(63) Continuation of application No. 14/682,400, filed on Apr. 9, 2015, now Pat. No. 9,321,288, which is a (Continued)

(30) Foreign Application Priority Data

Jan. 10, 2013 (JP) ..... 2013-002369

(51) Int. Cl.
*B41J 29/38* (2006.01)
*B41J 29/393* (2006.01)
(Continued)

(52) U.S. Cl.
CPC *B41J 15/16* (2013.01); *B41J 2/01* (2013.01); *B41J 11/007* (2013.01); *B41J 13/0009* (2013.01); *B41J 15/165* (2013.01)

(58) Field of Classification Search
CPC ..... B41J 11/0095; B41J 11/42; B41J 29/38; B41J 13/103; B41J 15/165; B41J 13/10; B41J 15/042; B41J 29/393; B41J 15/04; B41J 15/16; B41J 13/0009; B41J 11/007; B41J 2/01
(Continued)

(56) References Cited

U.S. PATENT DOCUMENTS 5,825,374 A 10/1998 Albertalli et al.
5,964,390 A 10/1999 Borresen et al.
(Continued)

FOREIGN PATENT DOCUMENTS

CN 101554806 A 10/2009
CN 102020128 A 4/2011
(Continued)

*Primary Examiner* — Jannnelle M Lebron

(57) ABSTRACT

An inkjet printer has a mechanism to counter change in the tension of the recording medium to convey the recording medium with more precision. Such printer has a media conveyance mechanism that conveys a recording medium; an inkjet printhead that prints on the conveyed medium when the printhead is located at a position opposed to the media conveyance mechanism; a media supply mechanism that supplies the medium to the media conveyance mechanism; a lever that is positioned between the media conveyance and media supply mechanisms and that moves to compensate and thus counter internal tension changes in the recording medium resulting from operation of these mechanisms; a detector that detects the movement or position of the lever; and a control unit that controls the media supply operation based on output from the detector so that the lever is urged back to or maintained in a home position.

8 Claims, 5 Drawing Sheets

Related U.S. Application Data continuation of application No. 14/147,861, filed on Jan. 6, 2014, now Pat. No. 9,028,034.

(51) Int. Cl.

| | |
|---|---|
| ***B41J 2/01*** | (2006.01) |
| ***B41J 15/16*** | (2006.01) |
| ***B41J 13/00*** | (2006.01) |
| ***B41J 11/00*** | (2006.01) |

(58) Field of Classification Search

USPC ..... 347/14, 16, 19, 101, 104, 219

See application file for complete search history.

(56) References Cited

U.S. PATENT DOCUMENTS

| | | | | |
|---|---|---|---|---|
| 6,276,587 | B1 | 8/2001 | Borresen et al. | |
| 7,568,651 | B2 | 8/2009 | Kessler | |
| 9,028,034 | B2 * | 5/2015 | Horaguchi | B41J 11/007 347/104 |
| 2009/0255971 | A1 | 10/2009 | Nakamaki et al. | |
| 2011/0063391 | A1 | 3/2011 | Miyamoto et al. | |
| 2012/0056365 | A1 | 3/2012 | Kato | |
| 2013/0033553 | A1 | 2/2013 | Kambara et al. | |
| 2013/0135370 | A1 | 5/2013 | Oba et al. | |

FOREIGN PATENT DOCUMENTS

| | | | |
|---|---|---|---|
| EP | 0 712 712 | A2 | 5/1996 |
| EP | 0 712 713 | A2 | 5/1996 |
| EP | 0 699 158 | B1 | 6/1997 |
| EP | 0 949 175 | A2 | 10/1999 |
| JP | 57-144780 | A | 9/1982 |
| JP | 08-113403 | A | 5/1996 |
| JP | 08-133540 | A | 5/1996 |
| JP | 2008-049670 | A | 3/2008 |
| JP | 2010-072010 | A | 4/2010 |
| JP | 2012-056110 | A | 3/2012 |

* cited by examiner

PRINTER WITH MECHANISM FOR CONTROLLING RECORDING MEDIUM TENSION

CROSS-REFERENCE TO RELATED APPLICATIONS

This application is a continuation of, and claims priority under 35 U.S.C. §120 on, U.S. application Ser. No. 14/682,400, filed Apr. 9, 2015, which is a continuation of U.S. application Ser. No. 14/147,861, filed Jan. 6, 2014 (now U.S. Pat. No. 9,028,034), which claims priority under 35 U.S.C. §119 on Japanese patent application no. 2013-002369, filed Jan. 10, 2013. The content of each such related application is incorporated by reference herein in its entirety.

BACKGROUND

1. Technical Field

The present disclosure relates to a method of printing and controlling a printer that can suppress variation in the tension of recording media.

2. Related Art

Inkjet and other types of printers print on a recording medium by driving a printhead synchronized to conveyance of the recording medium continuously or intermittently. When deviation in the conveyance speed of the recording medium occurs, deviation also occurs in the positioning of the printed dots, and good print quality cannot be maintained.

For example, if the back tension applied to the recording medium varies while printing with an inkjet line printer, the amount of slipping (slippage) between the recording medium and the conveyance roller that conveys the recording medium will vary. When slippage changes, the conveyance speed of the conveyance roller—and hence conveyance speed of the recording medium—varies. Because the inkjet head ejects ink droplets and forms a printed image at a regular interval or according to the conveyance distance of the recording medium synchronized to the continuous conveyance of the recording medium, variation also occurs in the printed image due to the change in speed when variation occurs in the conveyance speed of the recording medium. As a result, print quality is adversely affected. When printing on a recording medium with high rotational inertia, such as roll paper, a heavy acceleration load is applied to the recording medium immediately after acceleration, which can greatly affect the print quality. Constructions for absorbing or buffering variation in the back tension on the recording medium are therefore used, as described in JP-A-H08-133540 and JP-A-H08-113403.

The label printer disclosed in JP-A-H08-133540 uses a loop sensor to create slack (a loop) in the roll paper between the roll and the conveyance unit, and the roll paper is conveyed by the conveyance unit with constant tension. If the drive roller is stopped when a loop is desirably formed and the loop sensor then detects that the loop has gotten smaller, the drive roller is driven to advance the roll paper and increase the size of the loop.

The paper feed device described in JP-A-H08-113403 forms a loop in the paper between a loop roller and a guide roller, and the paper is conveyed at a constant speed by a conveyance belt after passing the guide roller. The loop in the paper is detected by a loop detection means (dancer roller). If the loop increases and the loop detection position reaches a minimum level, the paper feed roller that conveys the paper is slowed to increase the loop; if the loop decreases and the loop detection position reaches a maximum level, the paper feed roller is switched to a faster speed to decrease the loop.

The mechanisms according to the related art that buffer or suppress variation in the recording medium tension set a threshold value for detecting slack (loop size) in the recording medium, and either turn the recording medium conveyance operation on/off or switch the recording medium conveyance speed to a high or low speed based on the threshold. The tension on the recording medium can vary greatly when control changes with this type of switching control because the lever of the loop detection means that contacts the recording medium can swing greatly. Significant tension or significant slack can also be produced in the recording medium just before control changes. As a result, the conveyance speed of the recording medium can fluctuate greatly and maintaining good print quality can be difficult.

SUMMARY

An inkjet printer according to the present disclosure reduces tension on the recording medium or minimizes variation in tension (or variation in slack), and as a result can convey the recording medium with good precision.

An inkjet printer according to one aspect of the disclosure has a media conveyance mechanism that conveys a recording medium; a printhead that prints on the recording medium conveyed by the media conveyance mechanism when the inkjet printhead is located at a position opposed to the media conveyance mechanism; a media supply mechanism that supplies the recording medium to the media conveyance mechanism; a lever that is positioned between the media conveyance mechanism and the media supply mechanism, and is configured to move according to a change in the tension on the recording medium; a detector that detects the position or movement of the lever, which detection can be steplessly or in multiple steps; and a control unit that controls a supply operation of the recording medium by the media supply mechanism based on output from the detector so that the lever is maintained in or urged back to a home position.

According to this aspect of the disclosure, if the lever moves in the direction in which recording medium tension increases (or the direction in which recording medium slack decreases), the control unit drives the media supply mechanism to increase the supply speed or the supplied amount of the recording medium. If the lever moves in the direction in which recording medium tension decreases (or the direction in which recording medium slack increases), the control unit drives the media supply mechanism to decrease the supply speed of the recording medium or the amount supplied.

The related art switches the recording medium supply operation on or off, or switches the recording medium supply speed to a high or low speed, based on the movable member moving to a specific position. Because decreasing the tension on the recording medium is difficult, or decreasing the range of tension variation or the range of variation in slack is difficult, with this method, the conveyance speed of the recording medium can vary greatly and print quality can easily drop.

By continuously detecting the position or movement of the lever and controlling the recording medium supply operation based on such detection, as provided herein, the lever can be held or moved back to a home or target position with good precision. More specifically, the tension on the recording medium is kept low or variation in the tension (or variation in slack) is kept low. The recording medium conveyed past the printing position can therefore be conveyed with good precision at a constant speed, and good print quality can be maintained.

Preferably, the media conveyance mechanism comprises a conveyance motor, and a conveyance roller or conveyance belt driven by the conveyance motor, the surface of the belt acting as a platen.

The detector in this aspect of the disclosure can be a rotary encoder and an encoder plate that moves in unison with the lever, the detector further comprising another detector disposed opposite the encoder plate.

Further preferably, the lever has a media guide part supported thereon, and an urging member connected to the lever. In this configuration, the recording medium is mounted on the media guide part between the media supply mechanism and the media conveyance mechanism. The media guide part urges the recording medium mounted thereon by means of the urging member. As a result, the lever moves according to change in the tension on the recording medium (or change in slack). The recording medium is also held on the media guide member in a constantly tensioned state. In other words, the recording medium is held with a specific amount of slack between the media conveyance position and the media supply position.

In another aspect of the disclosure, the media supply mechanism includes a supply motor, and a supply roller or a supply belt driven by the supply motor.

To detect problems in the recording medium conveyance system, an allowed movement range is defined for the lever, and when the lever moves beyond this range, an error is detected and a specific error handling process, such as stopping the recording medium conveyance operation, is executed.

When continuous paper of fixed width wound onto a core to form a paper roll is delivered, little paper is left on the roll, and the trailing end of the paper (the end where winding onto the core begins) separates from the core, the back tension on the recording medium goes to zero. As a result, the lever moves outside the allowed movement range in the direction decreasing tension or the direction increasing slack. If the media supply mechanism continues the media supply operation in this event, the control unit will continue driving the recording medium at maximum speed in the rewind direction (the roll paper rewinding direction). To avoid such abnormal control, the control unit preferably unconditionally stops driving the media supply mechanism. The recording medium can be printed to the trailing end in this event by continuing the media conveyance operation of the media conveyance mechanism and the printing operation of the printhead.

If the trailing end of the recording medium conversely does not separate from the core and remains fastened to the core, the tension on the recording medium increases rapidly and the lever separates from the allowed movement range in the direction in which tension increases or slack decreases. In this event, the control unit attempts to drive the media supply mechanism at maximum speed in the direction supplying the recording medium, but the recording medium does not move. As a result, the motor that drives the media supply mechanism spins freely or starts rocking, and can possibly burn out. The media supply mechanism is therefore preferably stopped unconditionally. Because the recording medium cannot be conveyed, driving the media conveyance mechanism and the printhead is therefore also preferably stopped unconditionally (the printing operation is stopped unconditionally).

When printing on slips or other cut-sheet recording media, the tension on the recording medium does not vary during media conveyance, unlike when conveying roll paper or other continuous paper, and the media supply operation of the media supply mechanism is not required. The printer therefore preferably also has a mode selection unit that can selectively set an operating mode that drives the media supply mechanism, and a non-operating mode that does not drive the media supply mechanism, and the control unit executes the recording medium supply operation of the media supply mechanism only when the operating mode is set.

The inkjet printer of the disclosure can supply recording media from outside the printer, but configurations having a media storage compartment that stores the recording medium are also conceivable.

Other objects and attainments together with a fuller understanding of the disclosure will become apparent and appreciated by referring to the following description and claims taken in conjunction with the accompanying drawings.

DESCRIPTION OF EMBODIMENTS

Preferred embodiments of a printer according to the present disclosure are described below with reference to the accompanying figures. The following examples apply to an inkjet line printer according to the disclosure, but the disclosure can also be applied in printers with other types of printheads, such as thermal printers, as well as in serial printers.

Embodiment 1

Figure 1:
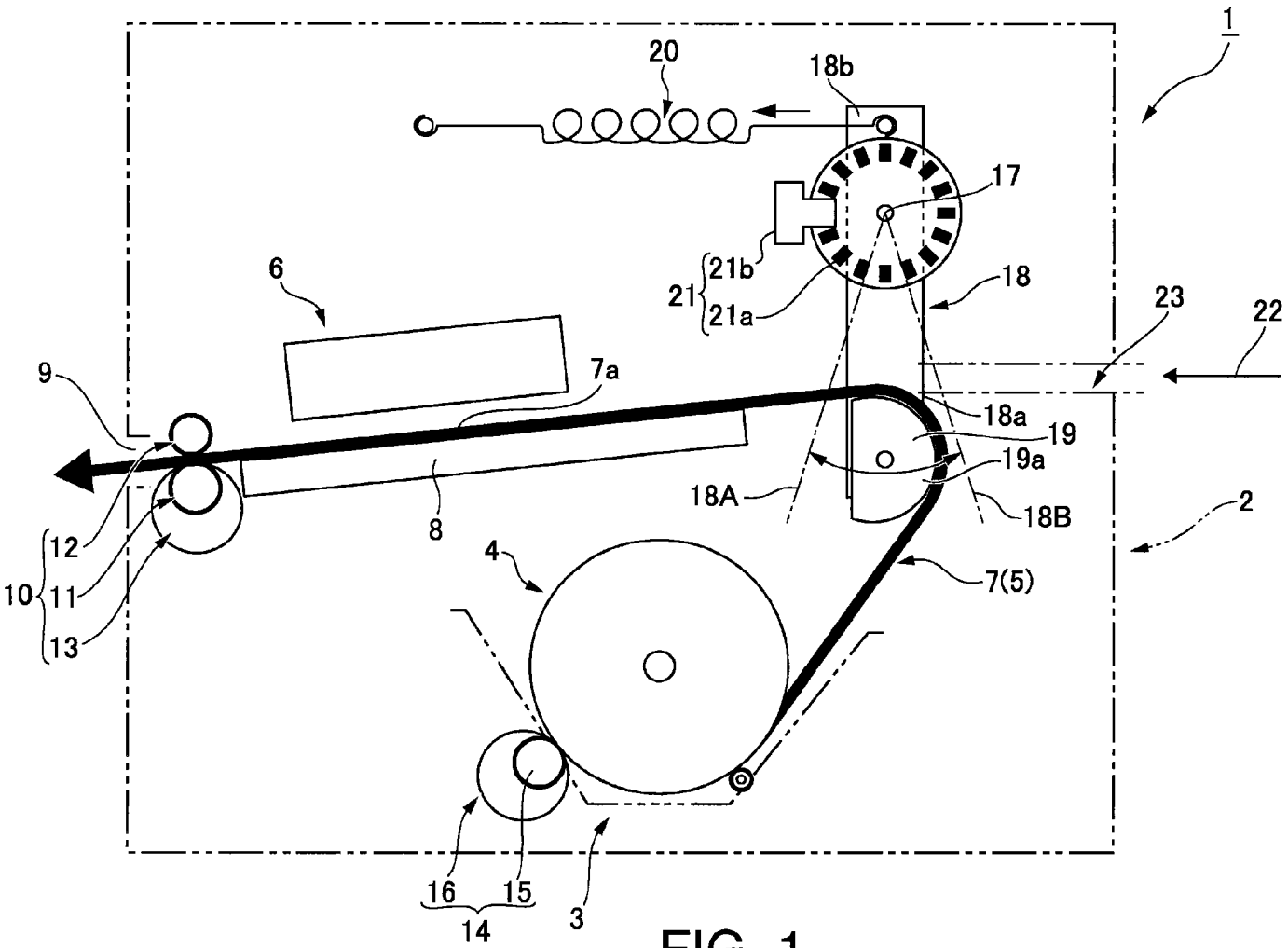
FIG. 1 schematically describes an example of an inkjet line printer according to the disclosure.

FIG. 1 schematically describes an inkjet line printer according to the first embodiment of the disclosure.

This inkjet line printer 1 (referred to below as simply printer 1) is a roll paper printer, and has a roll paper compartment 3 inside a printer cabinet 2 denoted by an imaginary line in the figure. A line printhead 6 (inkjet head) prints on continuous paper 5 of a specific width that is fed from a paper roll 4 stored in the roll paper compartment 3. The line printhead 6 has as row of ink nozzles that eject ink droplets, and the length of the ink nozzle row covers the maximum width of the continuous paper 5 that can be conveyed.

A media conveyance path 7 is formed inside the printer cabinet 2 as indicated by the bold line. The media conveyance path 7 travels from the roll paper compartment 3 past the printing position 7*a* of the printhead 6 to a media exit 9 disposed, for example, in the front of the printer cabinet 2. The printing position 7*a* on the media conveyance path 7 is determined by the top of the platen 8, and a media conveyance mechanism 10 is disposed downstream from the printing position 7*a*.

Figure 4:
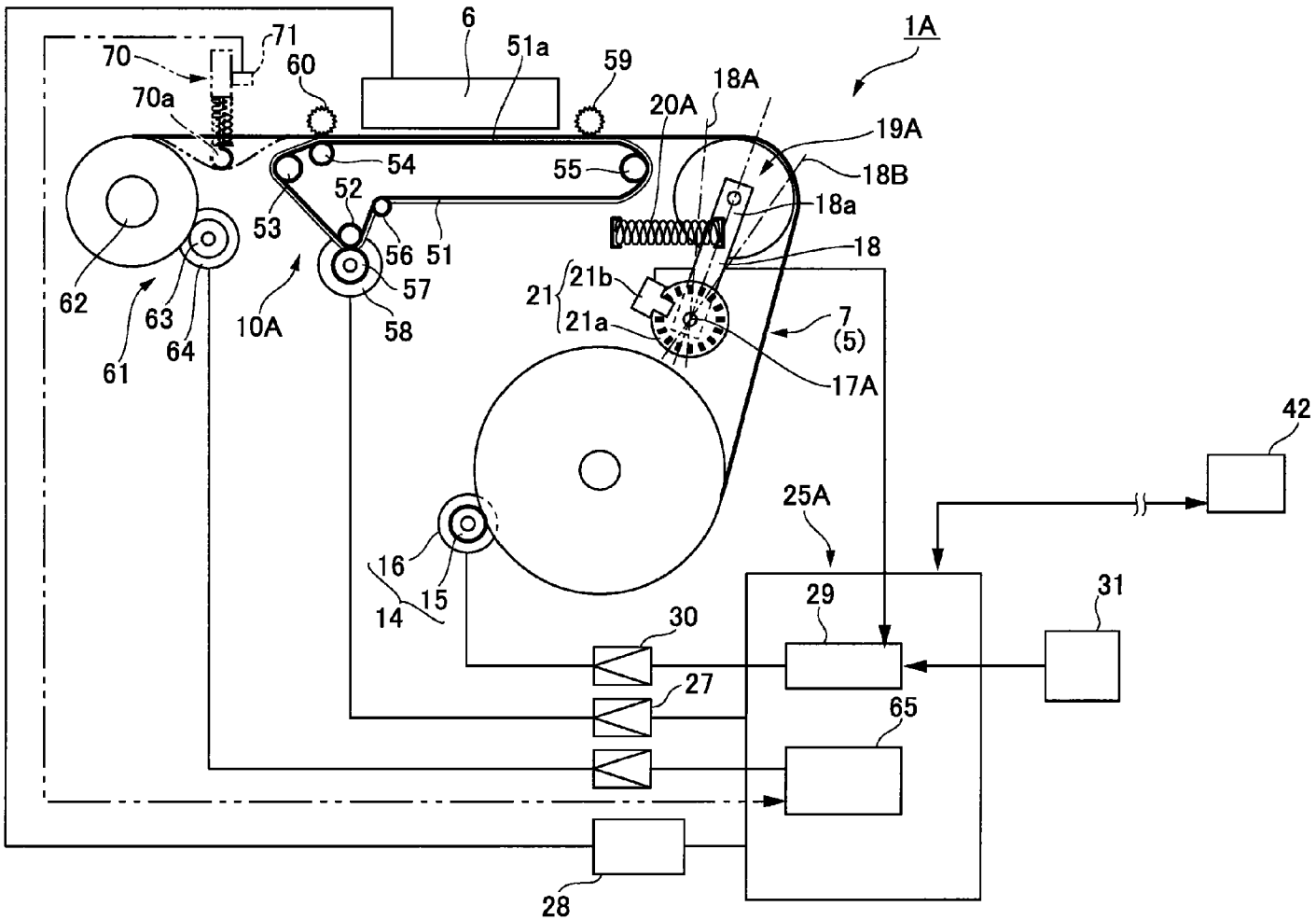
FIG. 4 schematically describes another example of an inkjet line printer according to the disclosure.
Figure 5:
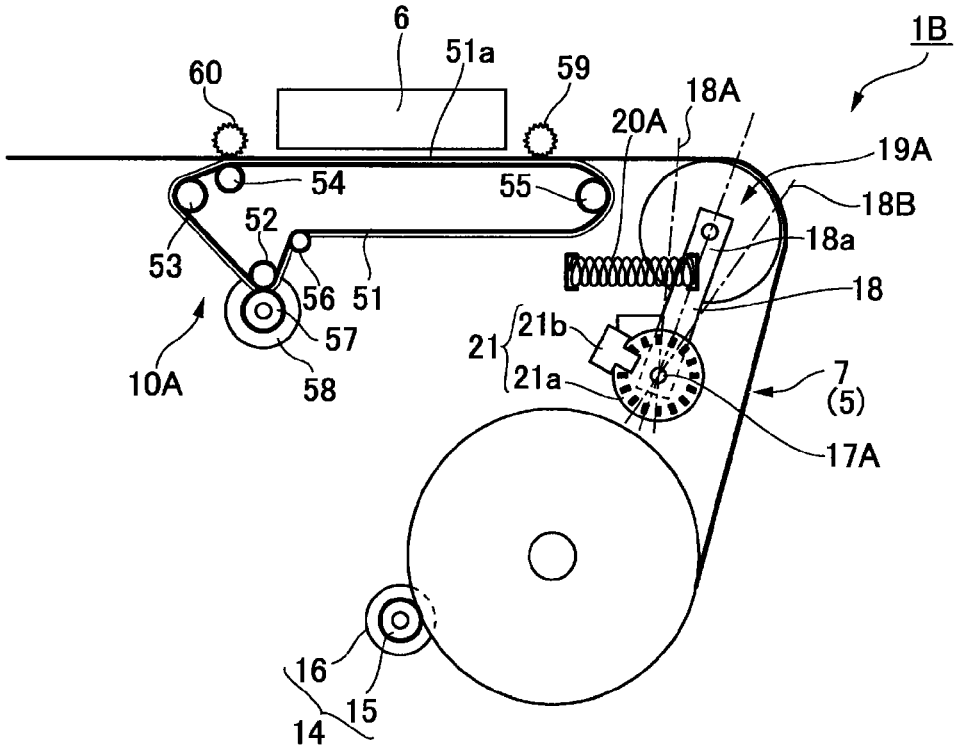
FIG. 5 describes a variation of the inkjet line printer shown in FIG. 4.

The media conveyance mechanism 10 includes a conveyance roller 11, a pressure roller 12 that is disposed opposite and presses the continuous paper 5 to the conveyance roller 11, and a conveyance motor 13 that rotationally drives the conveyance roller 11. The media conveyance position is the position where the continuous paper 5 is pressed against the conveyance roller 11 by the pressure roller 12. The media conveyance mechanism 10 could alternatively be a belt mechanism as shown in FIG. 4 and FIG. 5 and described below.

A media supply mechanism 14 is disposed in the roll paper compartment 3. The media supply mechanism 14 has a supply roller 15 and a supply motor 16 that rotationally drives the supply roller 15.

The supply roller 15 is located at the bottom of the roll paper compartment 3, and is supported in constant contact with the paper roll 4 in the roll paper compartment 3 from below (this contact position is the media supply position). The roll paper compartment 3 in this example is a roll paper compartment in which a paper roll is mounted on a spindle, the media supply mechanism 14 is connected to the spindle, and the paper roll 4 is turned on the spindle to feed the continuous paper 5. In this example the spindle is rotationally driven by the supply motor 16. Alternatively, the media conveyance mechanism 10 could be a belt mechanism.

A movable member that can move according to variation in the tension (or slack) in the conveyed continuous paper 5 is disposed to the media conveyance path 7 between the roll paper compartment 3 and the platen 8. In this embodiment the movable member is a slack lever 18, which is a lever that can pivot on a predetermined axis of rotation 17. A media guide member 19 is attached to one end 18*a* of the slack lever 18, and one end of a tension spring 20 is connected to the other end 18*b* of the slack lever 18 with the axis of rotation 17 therebetween. The other end of the tension spring 20 is connected to the printer cabinet frame (not shown in the figure) side.

The media guide member 19 has a curved outside surface 19*a* around which the continuous paper 5 passes. The slack lever 18 is urged by the spring force of the tension spring 20 in the direction increasing tension on the continuous paper 5, that is, in the direction increasing slack in the continuous paper 5. Note that the slack lever 18 could be a sliding lever that does not pivot on an axis of rotation 17 (in other words, a linear lever such as the movable member 70 shown in FIG. 4 described below).

A rotary encoder 21 is disposed to the axis of rotation 17 of the slack lever 18. The rotary encoder 21 includes an encoder disc 21*a* that rotates in unison with the slack lever 18 around the axis of rotation 17, and a detector 21*b* disposed to a fixed position opposite the outside edge part of the encoder disc 21*a*. The encoder disc 21*a* includes a group of slits (not shown in the figure) formed at a constant pitch around the circumference for detecting the rotational position, a pair of slits formed at a specific angular interval determining the allowable range of movement of the slack lever 18 (allowed pivot range) inside the group of slits, and an origin slit formed at one location determining the home position of the slack lever 18. As shown in the figure, the allowed range of movement of the slack lever 18 in this embodiment is from the tension-side limit position 18A to the slack-side limit position 18B.

The rotary encoder 21 can be constructed in various ways, and could be rendered to detect the rotational position of the slack lever 18 steplessly or in three or more multiple steps. An optical potentiometer, for example, can be used to detect the rotational position steplessly. In this configuration, an optically transmissive or reflective slit could be formed as a spiral (a slit formed so that the point where light passes moves radially in a 1:1 correlation to the rotational position) on a rotating disc that rotates in unison with the slack lever 18, and the position where light passes the slit detected by a transmissive (or reflective) photosensor. A sensor other than an optical sensor, such as a magnetic sensor, can obviously also be used.

Figure 2:
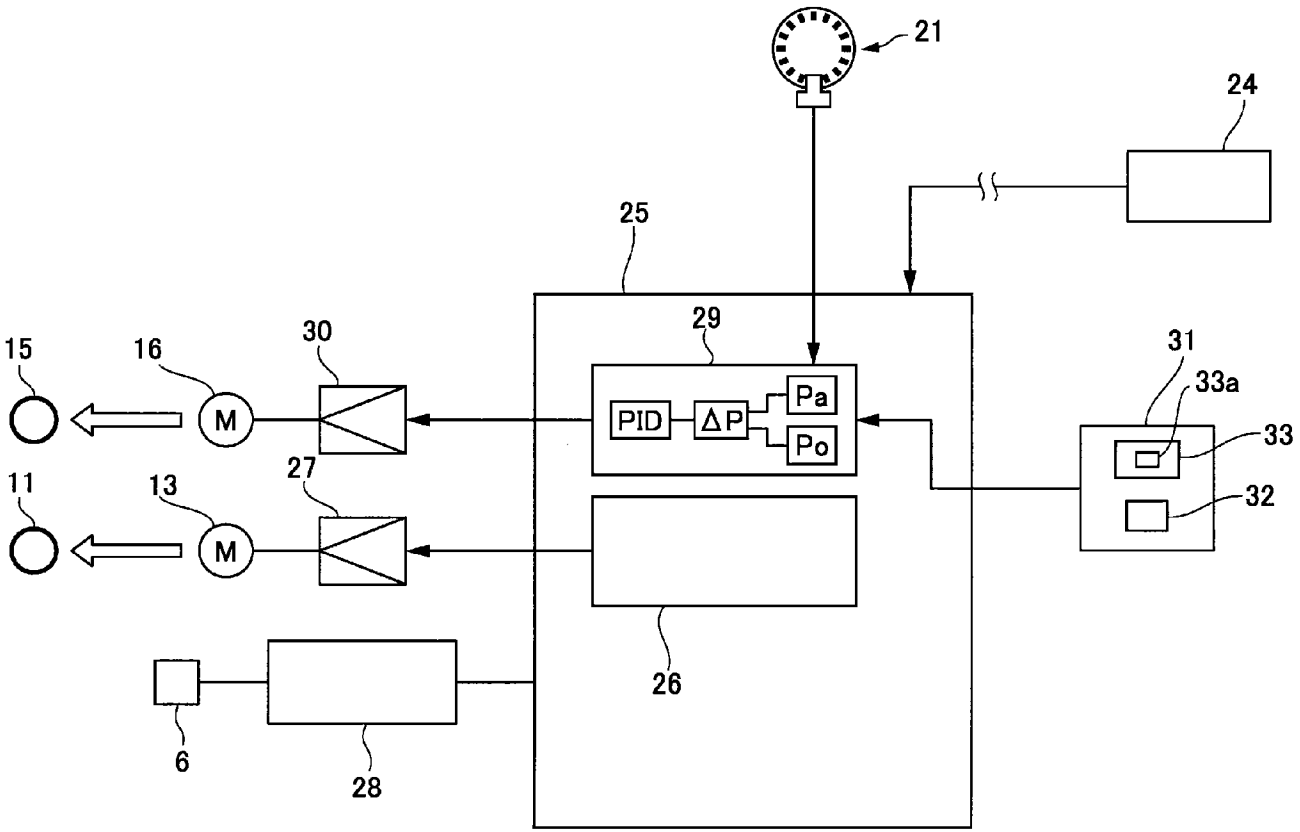
FIG. 2 schematically describes the control system of the inkjet line printer shown in FIG. 1.

FIG. 2 schematically describes the main parts of the control system of the printer 1 described above. The control system of the printer 1 is built around a printer control unit 25 including a microprocessor. The printer control unit 25 controls printing based on print commands from a host computer 24. The media conveyance controller 26 of the printer control unit 25 drives the conveyance motor 13 of the media conveyance mechanism 10 through a motor driver 27, and controls conveying the continuous paper 5 from the roll paper compartment 3 past the printing position 7*a* at a specific speed. The printer control unit 25 drives the printhead 6 through a head driver 28 synchronized to continuous paper 5 conveyance, and controls printing on the surface of the continuously conveyed continuous paper 5.

The media supply controller 29 of the printer control unit 25 drives the supply motor 16 of the media supply mechanism 14 through a motor driver 30 based on the output from the rotary encoder 21 so that the slack lever 18 is held at a predetermined position (or within a specific range). In other words, the media conveyance operation is controlled so that the tension or slack in the continuous paper 5 is held in a constant state (in a constant range).

For example, the rotational position Pa of the slack lever 18 is detected based on the detection signal from the rotary encoder 21. The detected rotational position is compared with a target position Po previously stored in internal memory to calculate deviation ΔP. The motor drive current is feedback controlled by a PID operation, for example, to eliminate this deviation ΔP. PD control or PI control may also be desirably used according to the configuration and characteristics (drive speed ratio, spring properties, roll diameter, continuous paper width) of parts including the media conveyance mechanism 10, media supply mechanism 14, slack lever 18, and paper roll 4.

An operating unit 31 is also connected to the printer control unit 25, and information including printer error states, for example, is displayed on the display unit 32 of the operating unit 31. Various settings can also be made through the input unit 33 of the operating unit 31. For example, when there is an insertion unit 23 for inserting cut-sheet paper 22 or continuous paper such as fanfold paper from the back of the printer cabinet 2 as indicated by the imaginary lines in FIG. 1, the media supply operation of the media supply mechanism 14 is not required in an operating mode that prints on recording media inserted from the insertion unit 23. In this event, the input unit 33 preferably has a selection unit 33*a* for selectively setting a drive mode that drives the media supply mechanism 14 or a non-drive mode that does not drive the media supply mechanism 14. This setting could obviously also be made from the host computer 24 side.

In the printer 1 described above, the continuous paper 5 pulled from the paper roll 4 loaded in the roll paper compartment 3 travels through a media conveyance path 7 passing around the media guide member 19 of the slack lever 18, past the printing position 7*a* and the media conveyance position of the media conveyance mechanism 10

(the nipping point of the conveyance roller 11 and pressure roller 12), and to the media exit 9.

A media indexing operation in which the media conveyance mechanism 10 is driven and the start printing position at the beginning of the continuous paper 5 is set to the printing position 7*a* is executed during the printing operation, for example. The continuous paper 5 is then continuously conveyed at a constant speed in a forward direction from the upstream side to the downstream side through the media conveyance path 7. Synchronized to media conveyance, the printhead 6 is driven to print specific content on the surface of the continuous paper 5 passing the printing position.

The tension on the continuous paper 5 can vary during continuous paper 5 conveyance. When media conveyance starts, for example, the continuous paper 5 to be conveyed is pulled opposite the conveyance direction by the inertia of the paper roll 4, and the tension on the continuous paper 5 momentarily increases. The inertia of the paper roll 4 increases with the size of the paper roll 4, and decreases as the amount of paper left on the paper roll 4 decreases. Change in tension on the continuous paper 5 at the start of media conveyance therefore varies according to the amount of paper remaining on the paper roll 4.

When the continuous paper 5 tension increases, the conveyance load of the continuous paper 5 on the conveyance roller 11 increases. Slipping therefore occurs between the conveyance roller 11 and the continuous paper 5, or slippage increases, and the continuous paper 5 cannot be conveyed with good precision. Because the slack lever 18 is pushed against the continuous paper 5 in this embodiment, the slack lever 18 pivots toward the tension-side limit position 18A when the tension on the continuous paper 5 increases (see FIG. 1). The increase in the tension on the continuous paper 5 is limited by the slack lever 18 pivoting.

When the continuous paper 5 is conveyed in reverse from the downstream side to the upstream side of the media conveyance path 7 to index the continuous paper 5, for example, the inertia of the paper roll 4 does not act on the continuous paper 5, and the tension on the continuous paper 5 decreases as the amount that the continuous paper 5 is reversed increases (as the slack in the continuous paper 5 increases). As a result, the slack lever 18 pivots toward the slack-side limit position 18B (FIG. 1). Tension on the continuous paper 5 is therefore maintained, and decrease in tension on the continuous paper is suppressed.

The media supply controller 29 of the printer control unit 25 monitors the detection signal from the rotary encoder 21 at a specific sampling period, and drives the media supply mechanism 14 and controls supplying the continuous paper 5 so that the slack lever 18 is held in a predetermined target pivot position. Variation in the tension on the continuous paper 5 is thereby suppressed, and the tension on the continuous paper 5 is held in a constant state.

FIG. 3 describes the continuous paper 5 conveyance operation and supply operation of the printer 1. FIG. 3A is a flow chart and FIG. 3B schematically describes operation when feeding the continuous paper 5 forward, and FIG. 3C is a flow chart and FIG. 3D schematically describes operation when conveying the continuous paper 5 in reverse.

Figure 3A:
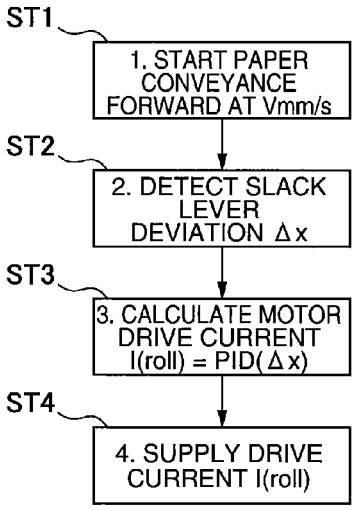
FIGS. 3A, 3B, 3C and 3D describe and illustrate the main operations of the inkjet line printer shown in FIG. 1.
Figure 3B:
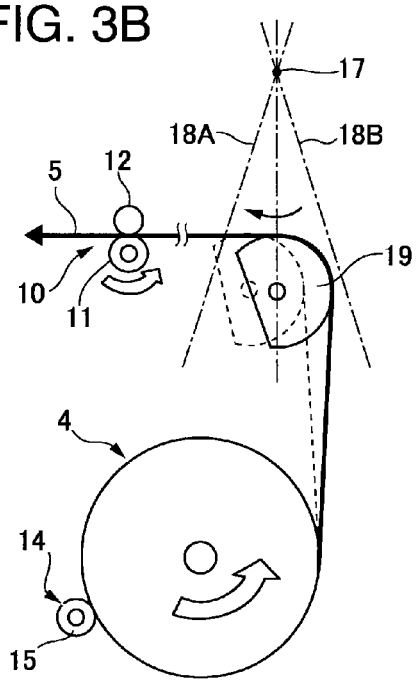

Referring first to FIG. 3A and FIG. 3B, the media conveyance mechanism 10 starts conveying the continuous paper 5 forward at conveyance speed Vmm/s (step ST1 in FIG. 3A). As a result, tension on the continuous paper 5 increases (slack in the continuous paper 5 decreases), and the slack lever 18 therefore pivots to the tension-side limit position 18A side. The media supply controller 29 of the printer control unit 25 detects the deviation Δx of the slack lever 18 from the target pivot position (step ST2), and calculates the motor drive current I(roll) in the direction eliminating this deviation Δx by PID control (step ST3). The media supply controller 29 then supplies the calculated motor drive current I(roll) to the motor driver 30, and drives the supply motor 16 in the supply direction delivering the continuous paper 5 from the paper roll 4 (step ST4). As a result, slack in the continuous paper 5 increases between the delivery position 4*a* of the paper roll 4 and the media conveyance position of the media conveyance mechanism 10, the slack lever 18 returns to the target pivot position side, and variation in the tension of the continuous paper 5 is suppressed or buffered.

Figure 3C:
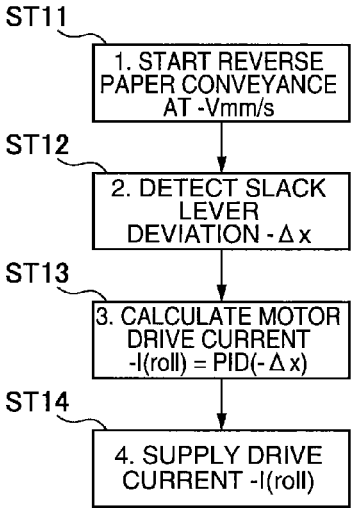
Figure 3D:
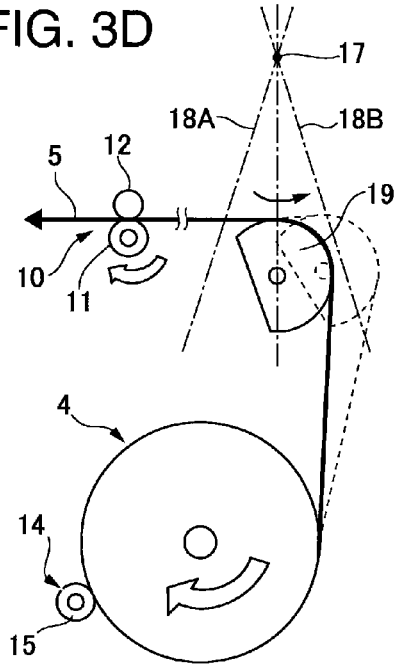

Referring next to FIG. 3C and FIG. 3D, the media conveyance mechanism 10 starts conveying the continuous paper 5 in reverse (step ST11 in FIG. 3C). If the conveyance speed when feeding forward is positive, the continuous paper 5 is conveyed in reverse at conveyance speed −Vmm/s. As a result, tension on the continuous paper 5 decreases (slack in the continuous paper 5 increases), and the slack lever 18 therefore pivots to the slack-side limit position 18B side. The media supply controller 29 of the printer control unit 25 detects the deviation −Δx of the slack lever 18 from the target pivot position (step ST12), and calculates the motor drive current −I(roll) in the direction eliminating this deviation −Δx by PID control (step ST13). The media supply controller 29 then supplies the calculated motor drive current −I(roll) to the motor driver 30, and drives the supply motor 16 in reverse in the direction rewinding the continuous paper 5 onto the paper roll 4 (step ST14). As a result, slack in the continuous paper 5 decreases between the delivery position 4*a* of the paper roll 4 and the media conveyance position of the media conveyance mechanism 10, the slack lever 18 returns to the target pivot position side, and variation in the tension of the continuous paper 5 is suppressed or buffered.

The allowable pivot range of the slack lever 18 in this embodiment is limited to the range from the tension-side limit position 18A to the slack-side limit position 18B. More specifically, when the slack lever 18 reaches either limit of the allowable pivot range, the media supply controller 29 determines there is a problem in the continuous paper 5 supply operation, and displays an appropriate notice to the user on the display unit 32 of the operating unit 31. When this occurs while printing, the media supply controller 29 in this embodiment controls the media supply operation as described below.

First, when delivering the continuous paper 5 from the paper roll 4, the paper roll 4 may become depleted and the trailing end of the paper (the end first wound onto the core) may separate from the core. When this happens, the continuous paper 5 is released from restraint on the roll paper compartment 3 side, and the back tension on the continuous paper 5 disappears. As a result, the slack lever 18 swings to the slack-side limit position 18B due to the force of the tension spring 20. If the media supply operation of the media supply mechanism 14 continues in this event, the media supply controller 29 will continuously drive the continuous paper 5 at maximum speed in reverse (the rewinding direction) in order to reduce slack in the continuous paper 5.

To avoid this abnormal control operation, the media supply controller 29 determines that there is no more continuous paper 5 when the slack lever 18 swings to the slack-side limit position 18B (determines that the roll paper has run out), and unconditionally stops driving the media supply mechanism 14. The continuous paper 5 can be printed to the end in this event by continuing the media conveyance operation with the media conveyance mechanism 10 and the printing operation with the printhead 6.

In some cases, the trailing end of the continuous paper 5 may conversely not separate from the core and remain fastened to the core. In this event the back tension on the continuous paper 5 increases rapidly and the slack lever 18 swings to the tension-side limit position 18A. If the media supply controller 29 continues driving the media supply mechanism 14 when this happens, the maximum drive current is supplied to the supply motor 16, but the supply motor 16 spins freely or starts rocking, and can possibly burn out. To avoid such problems, the media supply controller 29 determines that there is no more continuous paper 5 (the paper roll 4 ran out) when the slack lever 18 swings to the tension-side limit position 18A, unconditionally stops the media supply mechanism 14, and unconditionally stops driving the media conveyance mechanism 10 and the printhead 6 (stops printing).

As described above, the printer 1 has a media conveyance mechanism 10, can effectively suppress variation in the tension applied to the continuous paper 5, and can suppress the range of tension variation. As a result, the precision of continuous paper 5 conveyance past the printing position 7*a* can be assured, and high print quality can be maintained.

The media supply position of the supply roller 15 in the media supply mechanism 14 is a position in contact with the paper roll 4 in this example. When the continuous paper 5 is reversed, the continuous paper 5 can therefore be rewound onto the paper roll 4, creases and wrinkles in the continuous paper 5 can be suppressed or prevented, and consistently stable media conveyance is possible.

Furthermore, because the tension on the continuous paper 5 can be reduced, conveyance roller 11 wear caused by slipping between the conveyance roller 11 and the continuous paper 5 can be reduced. Media can therefore be conveyed stably for a long time.

When the printer has plural print modes and the media conveyance speed differs according to the print mode, feedback gain for media supply control can be set appropriately according to the media conveyance speed. For example, the PID control gain can be set according to the media conveyance speed. As a result, variation in media back tension can be effectively controlled in each print mode according to the media conveyance speed.

Embodiment 2

FIG. 4 schematically describes an inkjet line printer according to a second embodiment of the disclosure. The basic configuration of this inkjet line printer 1A is identical to the printer 1 described above, like parts are identified by like reference numerals, and further description thereof is omitted.

This inkjet line printer 1A uses a belt-type media conveyance mechanism 10A as the media conveyance mechanism. This belt-type media conveyance mechanism 10A has a conveyance belt 51, a plurality of guide rollers 52 to 56 on which the conveyance belt 51 is mounted, a belt drive roller 57 that drives the conveyance belt 51, and a conveyance motor 58 that rotationally drives the belt drive roller 57. One guide roller 52 is pressed to the belt drive roller 57 with the conveyance belt 51 therebetween. The conveyance belt 51 has a conveyance belt portion 51*a* spanning the part of the media conveyance path 7 including the printing position 7*a* of the printhead 6. A pinch roller 59, 60 is disposed to the upstream end and the downstream end of the conveyance belt portion 51*a* in the conveyance direction, and presses the continuous paper 5 to conveyance belt portion 51*a*.

The inkjet line printer 1A has a media rewinding mechanism 61 that rewinds the continuous paper 5 fed to the downstream side by the conveyance belt 51 after printing. The media rewinding mechanism 61 includes a media take-up roll 62, a media winding roller 63 held in contact with the outside surface of the media take-up roll 62, and a winding motor 64 that rotationally drives the media winding roller 63.

The slack lever 18 in this example can pivot at a position on the roll paper compartment 3 side of the media conveyance path 7 as the axis of rotation 17A. A rotary encoder 21 has an encoder disc 21*a* that rotates in unison with the slack lever 18 around the axis of rotation 17A. A tension roller 19A that rotates freely is attached to one end 18*a* of the slack lever 18 as a media guide member, and the continuous paper 5 travels around the tension roller 19A.

A compression spring 20A is connected between the tension roller 19A and the axis of rotation 17A of the slack lever 18, and urges the slack lever 18 to the slack-side limit position 18B side.

The printer control unit 25A has a media winding controller 65 that controls driving the media rewinding mechanism 61. The media winding controller 65 controls the media winding operation of the media rewinding mechanism 61 synchronized to the media conveyance mechanism 10A.

The inkjet line printer 1A according to this embodiment of the disclosure achieves the same effect as the printer 1 described above. High durability, stable belt conveyance is also possible because variation in tension on the continuous paper 5 can also be reduced. More specifically, durability can be increased by using a hard material on the surface of the conveyance roller in a roller system, but because rubber, urethane, or similar material is used in a belt conveyance system, wear increases and durability decreases as a result of slipping between the continuous paper 5 and the conveyance belt 51. This embodiment of the disclosure can reduce tension on the continuous paper 5 and suppress the range of tension variation, and thereby reduce conveyance belt 51 wear and convey media stably for a long time.

Operation of the media rewinding mechanism 61 in this inkjet line printer 1A can be controlled in the same way as the media supply control operation using a slack lever. For example, as shown by the imaginary line in FIG. 4, a movable member 70 that can move according to the change in tension or the change in slack in the continuous paper 5 taken up by the media rewinding mechanism 61 is disposed to the media conveyance path between the media conveyance mechanism 10A and the media rewinding mechanism 61. In this example, a tension roller 70*a* on the distal end of the linear movable member 70 that is urged in the protruding direction by a spring is disposed pushing against the continuous paper 5. A detector 71 detects the position of the tension roller 70*a* of the movable member 70, and based thereon the media winding controller 65 of the printer control unit 25A controls the media winding operation so that the change in tension or slack in the continuous paper 5 is kept within a specific range.

As a result, the continuous paper 5 passing the printing position 7*a* on the upstream side can be conveyed stably with good precision at a constant speed. The continuous paper 5 that is rewound by the media rewinding mechanism 61 can also be reliably prevented from sagging and becoming folded or wrinkled, or jamming.

As shown in FIG. 5, the media rewinding mechanism 61 can also be omitted from the inkjet line printer 1A. The same effects achieved by the inkjet line printers 1, 1A described above can also be achieved by means of the media supply control operation in this inkjet line printer 1B.

The disclosure being thus described, it will be obvious that it may be varied in many ways. Such variations are not to be regarded as a departure from the spirit and scope of the disclosure, and all such modifications as would be obvious to one skilled in the art are intended to be included within the scope of the following claims.

What is claimed is:

1. An inkjet printer comprising:

a media conveyance mechanism that conveys a recording medium in a conveyance path;

an inkjet printhead that prints on the recording medium conveyed by the media conveyance mechanism;

a media supply mechanism that supplies the recording medium to the media conveyance mechanism;

a lever configured to contact the recording medium in the conveyance path between the media conveyance mechanism and the media supply mechanism and to move between a first position and a second position;

a detector that detects movement of the lever; and a controller that controls the media supply mechanism, wherein when a tension of the recording medium between the media conveyance mechanism and the media supply mechanism increases, the recording medium moves the lever toward the first position, in a conveyance operation in which the recording medium is conveyed in a direction from the media supply mechanism to the media conveyance mechanism, the controller determines whether the lever is on a first side of a specific position or not based on an output from the detector, the specific position being between the first position and the second position, when the controller determines that the lever is on the first side, the controller controls the media supply mechanism to supply the recording medium toward the media conveyance mechanism at a first supplying speed, and when the controller determines that the lever is not on the first side, the controller controls the media supply mechanism to supply the recording medium toward the media conveyance mechanism at a second supplying speed which is lower than the first supplying speed, or not to supply the recording medium to the media conveyance mechanism.

2. The inkjet printer described in claim 1, wherein:

the detector is configured to detect the movement of the lever in three or more steps.

3. The inkjet printer described in claim 1, wherein:

the recording medium is printed by the inkjet printhead in the conveyance path, and the media conveyance mechanism comprises a conveyance motor, and a conveyance roller driven by the conveyance motor, which is configured to contact the recording medium between the media supply mechanism and the printing position.

4. The inkjet printer described in claim 1, wherein:

the detector comprises a rotary encoder including an encoder plate that rotates by the movement of the lever.

5. The inkjet printer described in claim 1, further comprising:

an urging member that urges the lever toward the second position; wherein the lever includes a media guide part, the media guide part contacts the recording medium between the media supply mechanism and the media conveyance mechanism, and the media guide part urges the recording medium according to the force of the urging member.

6. The inkjet printer described in claim 1, wherein:

the media supply mechanism supplies the recording medium from a roll by rotating the roll, the media supply mechanism includes a supply motor, and a supply roller driven by the supply motor, and the supply roller contacts a surface of the roll.

7. The inkjet printer described in claim 1, wherein:

the controller determines whether the lever is in a predetermined allowed movement range or not during printing on the recording medium by the inkjet printhead, when the controller determines that the lever is outside of the allowed movement range on the first side, the controller stops the media supply mechanism, the media conveyance mechanism, and the inkjet printhead, and when the controller determines that the lever is outside of the allowed movement range on the second side, the controller stops the media supply mechanism and drives the media conveyance mechanism.

8. The inkjet printer described in claim 1, wherein:

the recording medium is printed by the inkjet printhead at a print position in the conveyance path, and the media conveyance mechanism comprises a conveyance motor, and a conveyance belt driven by driven by the conveyance motor, a surface of the conveyance belt including the print position.

* * * * *